US007189116B2

(12) United States Patent
Wei

(10) Patent No.: US 7,189,116 B2
(45) Date of Patent: Mar. 13, 2007

(54) ELECTRONIC CONNECTOR WITH AN ENHANCED HOLDING FUNCTION

(75) Inventor: Kuan-Yang Wei, Taoyuan (TW)

(73) Assignee: P-Two Industries Inc., Taoyuan (TW)

( * ) Notice: Subject to any disclaimer, the term of this patent is extended or adjusted under 35 U.S.C. 154(b) by 0 days.

(21) Appl. No.: 11/335,670

(22) Filed: Jan. 20, 2006

(65) Prior Publication Data

US 2006/0264103 A1 Nov. 23, 2006

(30) Foreign Application Priority Data

May 23, 2005 (TW) ..... 94116669 A

(51) Int. Cl.
*H01R 13/648* (2006.01)

(52) U.S. Cl. ..... 439/607

(58) Field of Classification Search ..... 439/607
See application file for complete search history.

(56) References Cited

U.S. PATENT DOCUMENTS 6,095,863 A * 8/2000 Tung ..... 439/607
6,152,774 A * 11/2000 Yu ..... 439/607
6,659,791 B1 * 12/2003 Ko et al. ..... 439/353
6,913,488 B2 * 7/2005 Motojima et al. ..... 439/607

* cited by examiner

*Primary Examiner*—Truc Nguyen
(74) *Attorney, Agent, or Firm*—Troxell Law Office, PLLC

(57) ABSTRACT

An electronic connector with an enhanced holding function is composed of a seat, a casing, a plurality of conduction terminals, and a holding element. The holding element is transfixed on the seat corresponding to the conduction terminals, and the casing is latched with the seat from a direction opposite to an insertion direction of holding element, and encloses an outside of the seat. The holding element is provided with a plurality of press pieces which are overlapped with spring leaves of casing in the seat and are interfered with the spring leaves along a first direction, such that holding element and casing will not be easily separated from the seat or be shifted or loosened. In addition, by the aforementioned fixing structures, the holding element and conduction terminals are provided with a better holding capability, in order to fix a butted connector.

3 Claims, 8 Drawing Sheets

B-B

A-A

ELECTRONIC CONNECTOR WITH AN ENHANCED HOLDING FUNCTION

BACKGROUND OF THE INVENTION (a) Field of the Invention

The present invention relates to an electronic connector with an enhanced holding function, and more particularly to a socket connector which is used in connecting a soft bus and is provided with a high holding capability and a function of repeated insertion and pull.

(b) Description of the Prior Art

A conventional electronic connector used in connecting a soft bus, especially a thin-type socket connector applied in a liquid crystal display panel, is primarily composed of a plastic seat, a metallic casing, and a plurality of conduction terminals. Due to a requirement of thinning for this kind of connector, one side of the plastic seat is usually removed to constitute a insertion space by the plastic seat and the metallic casing. After a butted connector is inserted, one side of a connecting part of the butted connector is pressed against the conduction terminals for connecting electronically; whereas the other side is pressed against the metallic casing for grounding. In order to enable the thin-type socket connector to have a better holding capability and grounding function, so as to prevent the butted connector from being improperly separated, the Taiwan Utility Patent 91217332 discloses a socket connector wherein a plurality of spring leaves being extended toward an interior of insertion space are integrally formed and located on a wall of one side of the metallic casing corresponding to the conduction terminals. After the butted connector is inserted, two sides of the butted connector are firmly held by the conduction terminals and the spring leaves, and are provided with an effect of enhanced grounding connection. However, this kind of design can relatively form damage to the metallic casing, and reduce the holding strength instead. In addition, the holding effect is not obvious either, even by increasing a thickness of metallic casing.

Additionally, there is a design wherein a grounding piece is added between the conduction terminals and the metallic casing, and then the metallic casing is grounded by using the grounding piece to touch with the metallic casing, so as to replace the original method of directly using the metallic casing for grounding. After the butted connector is inserted, the connecting part of butted connector is held by the conduction terminals and the grounding piece at the same time, to improve a shortcoming of inferior holding capability. However, as the grounding piece is usually fixed between the two side ends and the plastic seat; therefore, when the number of connection terminals of socket connector is increased, the length of grounding piece should be increased. Comparing with the two sides, usually a central part of the grounding piece is gradually separating toward an exterior under a repeated insertion and pull, and forms damage eventually. In the mean time, as the grounding piece is not perfectly pressed against the metallic casing, an open circuit or other damage will easily happen.

Furthermore, as the metallic casing, which is installed on an outside of plastic seat from one direction, is in lack of interference and fixing from the opposite direction, a shifting and escaping will frequently happen, under a repeated usage.

SUMMARY OF THE INVENTION

The primary object of the present invention is to provide an electronic connector with an enhanced holding function to increase the holding function between the electronic connector and a butted connector.

Another object of the present invention is to provide an electronic connector with an enhanced holding function, such that a mutually interfering and fixing function can be formed between a casing and a holding element, along an assembling direction, to prevent these two from being separated due to an external force, and to increase a lifetime of usage of the electronic connector.

Still another object of the present invention is to provide an electronic connector with an enhanced holding function, such that every part of the holding element can be uniformly fixed, thereby forming a stable contact force.

Accordingly, the present invention is an electronic connector with an enhanced holding function which comprises a seat, a casing, a plurality of conduction terminals, and a holding element. The holding element and the conduction terminals, which are corresponding to each other, are penetrated into and fixed inside the seat, and the casing is latched with the seat from a direction opposite to an insertion direction of the holding element, and encloses an outside of the seat. The holding element is provided with a plurality of press pieces which are overlapped with spring leaves of casing, at an upper slot in the seat, and they are interfered with each other along a first direction, such that the holding element and the casing will not be easily separated from the seat or be shifted or loosened. In addition, by the aforementioned fixing structures, a better holding force can exist between the holding element and the conduction terminals to fix a butted connector.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
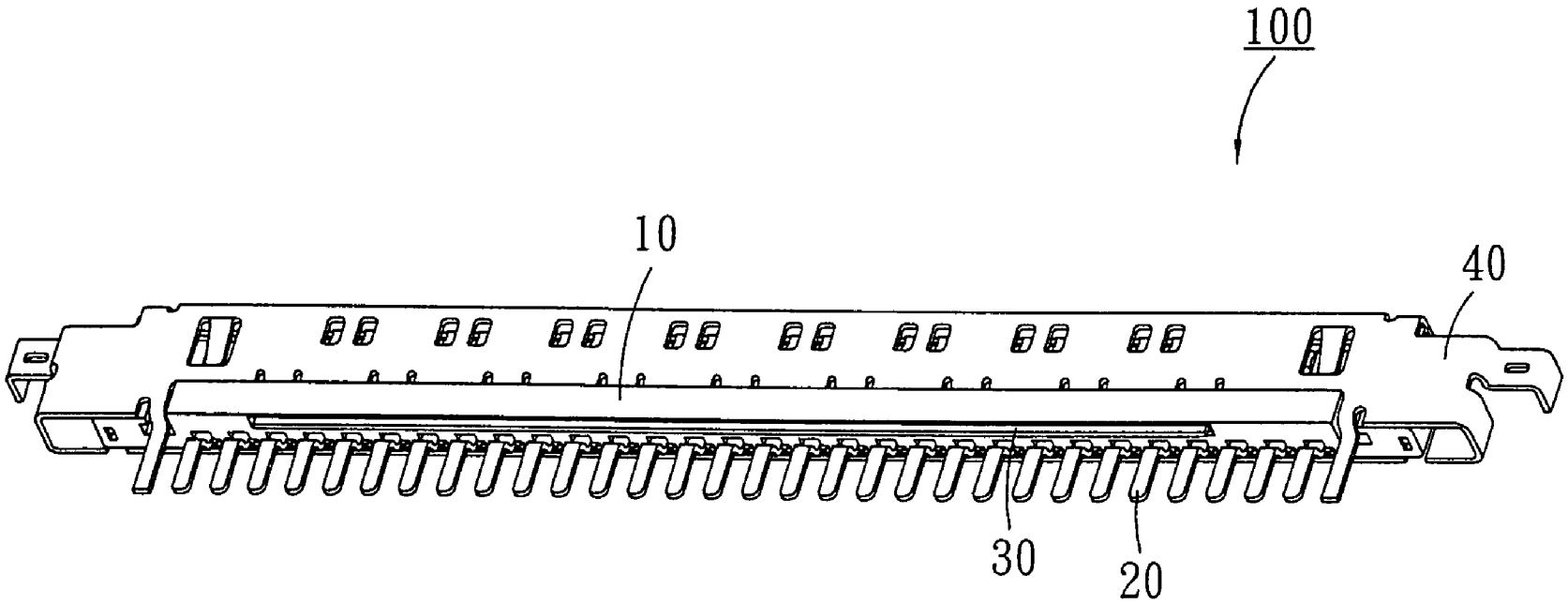
FIG. 1 shows a perspective view of an implementation of the present invention after being assembled.
Figure 2:
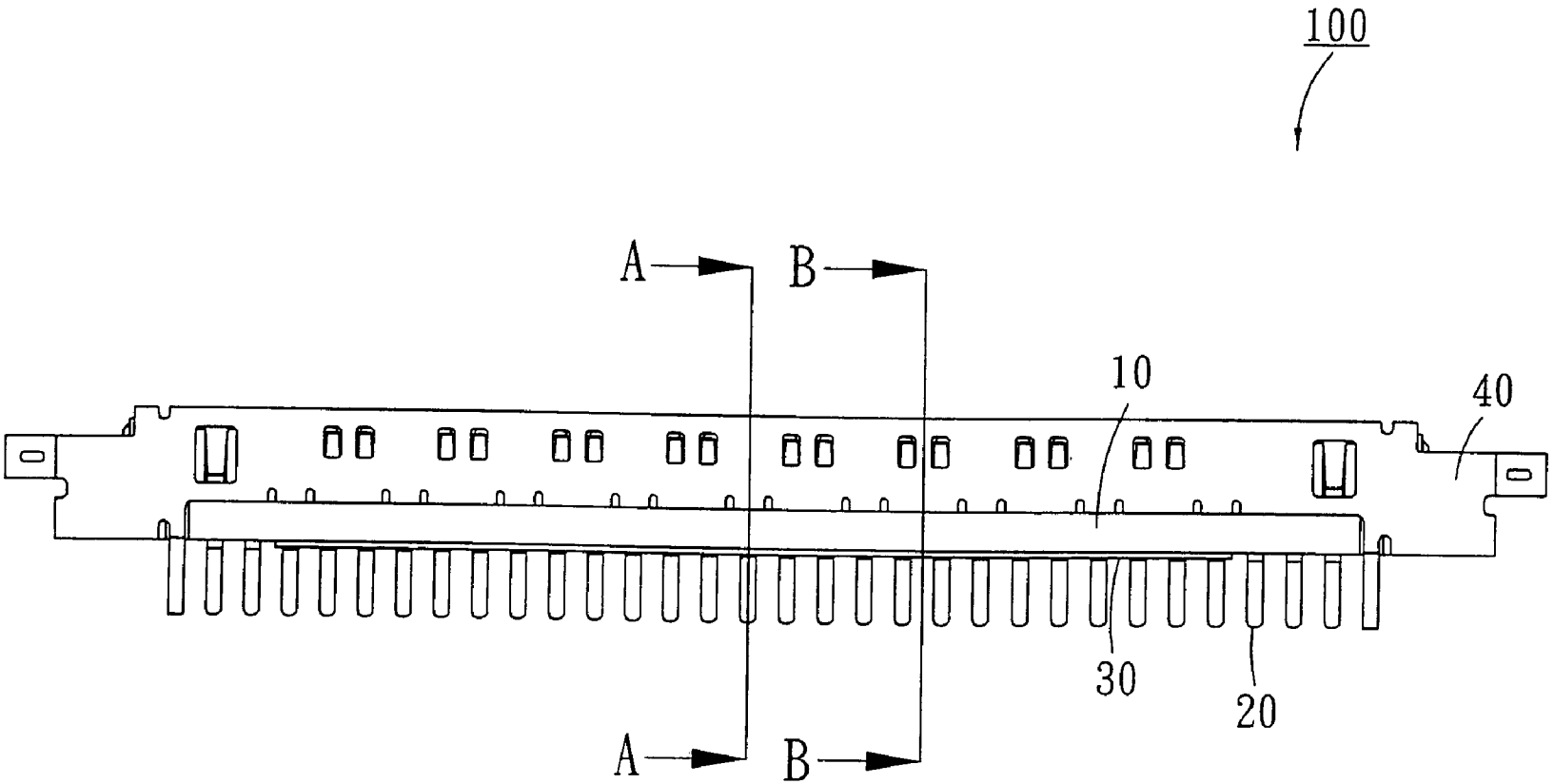
FIG. 2 shows a top view of an implementation of the present invention.

Referring to FIG. 1, FIG. 2, FIG. 3, and FIG. 4, an electronic connector 100 includes a seat 10 which is a roughly L-shaped plastic frame formed integrally, an upper slot 111 and a plurality of terminal slots 112 transfixed on a rear side of the seat 10 wherein the terminal slots 112 are extended to an inner surface 113 of the seat 10, slot tunnels 121 and latching holes 122 are located at positions near a left and right sides of the seat 10, and a plurality of conduction terminals 20 each of which is separated individually, aligned in an equal distance along a first direction A1, and inserted into the terminal slot 112 with a central part 21. A contact end 22 is extended from the conduction terminal 20 and installed in the inner surface 113 of seat 10, and is roughly bended toward an exterior; whereas another welding end 23 is extended toward an exterior of seat 10 to be fixed with a circuit board.

A holding element 30 is inserted from a rear side 11 of seat 10 and fixed in the upper slot 111. The holding element 30 is extended and connected along a second direction A2, and is provided with a plurality of holding terminals 31 and a plurality of press pieces 33 which are extended along the first direction A1 perpendicular to the second direction A2. A front rim of the holding terminal 31 is provided with a bended contact part 311, and the press piece 33 is provided with an upward or downward projection part 331. In this implementation, every two holding terminals 31 is taken as a terminal set 32, and the press piece 33 is alternately located between two terminal sets 32, such that a first gap 341 is formed between the press piece 33 and the holding terminal 31, and a second gap 342 is formed between two holding terminals 31, due to a requirement of product design.

A frame-shaped metallic casing 40 is latched with the seat 10 from a direction opposite to an insertion direction of the conduction terminals 20 and holding element 30, and encloses an outside of the seat 10. A holding space 13 is formed by a side surface 41 of casing 40 and the inner surface 113 of seat 10, in order to insert a butted connector. A plurality of notches 411, and numeral grounding pieces 412 which are tilted toward an internal of holding space 13, are located on the side surface 41 of casing 40, a plurality of spring leaves 42 at positions corresponding to the press pieces 33 of holding element 30 are located on an edge of side surface 41, and a latching member 43 and a grounding part 44 are located at two sides of casing 40, respectively. The electronic connector with an enhanced holding function of present invention is composed of the aforementioned seat 10, the plurality of conduction terminals 20, the holding element 30, and the casing 40.

Figure 3:
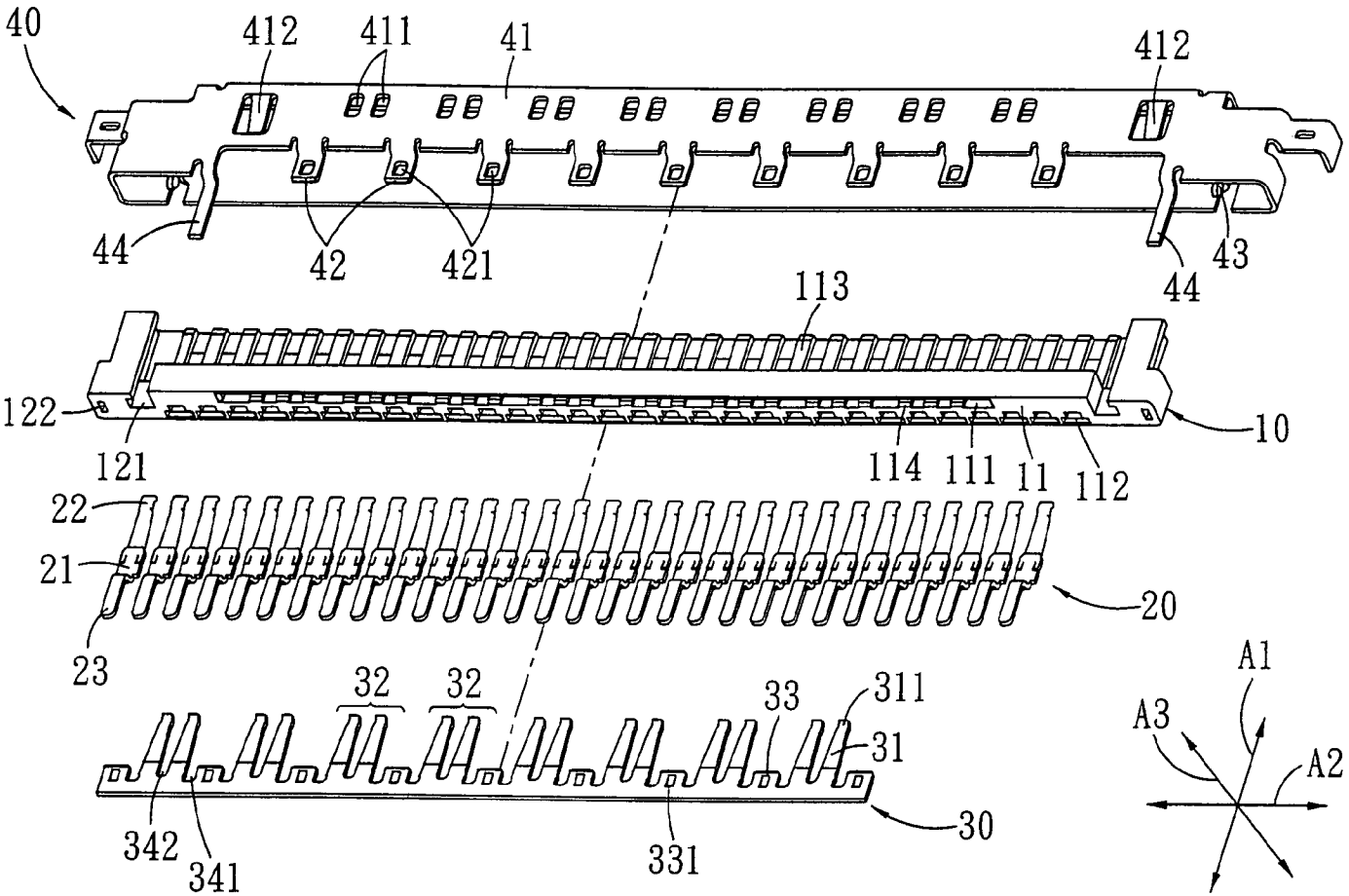
FIG. 3 shows a perspective view of elements of an implementation of the present invention before being assembled.

The upper slot 111 of seat 10 is used to insert and fix the holding element 30, such that the plurality of holding terminals 31 can be extended into the seat 10. The contact part 311 is installed corresponding to the contact end 22 of conduction terminal 20, such that a contact part of the butted connector being inserted is held by the conduction terminal 20 and the holding terminal 31 opposite to each other at the same time, thereby preventing the butted connector from being separated due to an insufficiency of holding force. Referring to FIG. 3, to sufficiently fix the holding element 30, the upper slot 111 is provided with a plurality of bumps 114 whose positions are matched with a shape of holding element 30. When the holding element 30 is inserted in the upper slot 111, each bump 114 is just pressed against an inner rim of the first gap 231 and the second gap 342, to specifically define a position of each holding terminal 31 and press piece 33. In this implementation, the bump 114 is used to connect edges of upper and lower sides of upper slot 111, to assure strength of edges of upper and lower sides of upper slot 111, and to prevent a deformation. In another implementation, the bump 114 can be extended from any side edge of upper slot 111 to the other side edge without connecting with the other edge. In particular, the bump 114 pressed against the second gap 342 can be extended from any side edge of upper slot 111 to the other side edge, and can be directly pressed at a connection point between two holding terminals 31.

Figure 4:
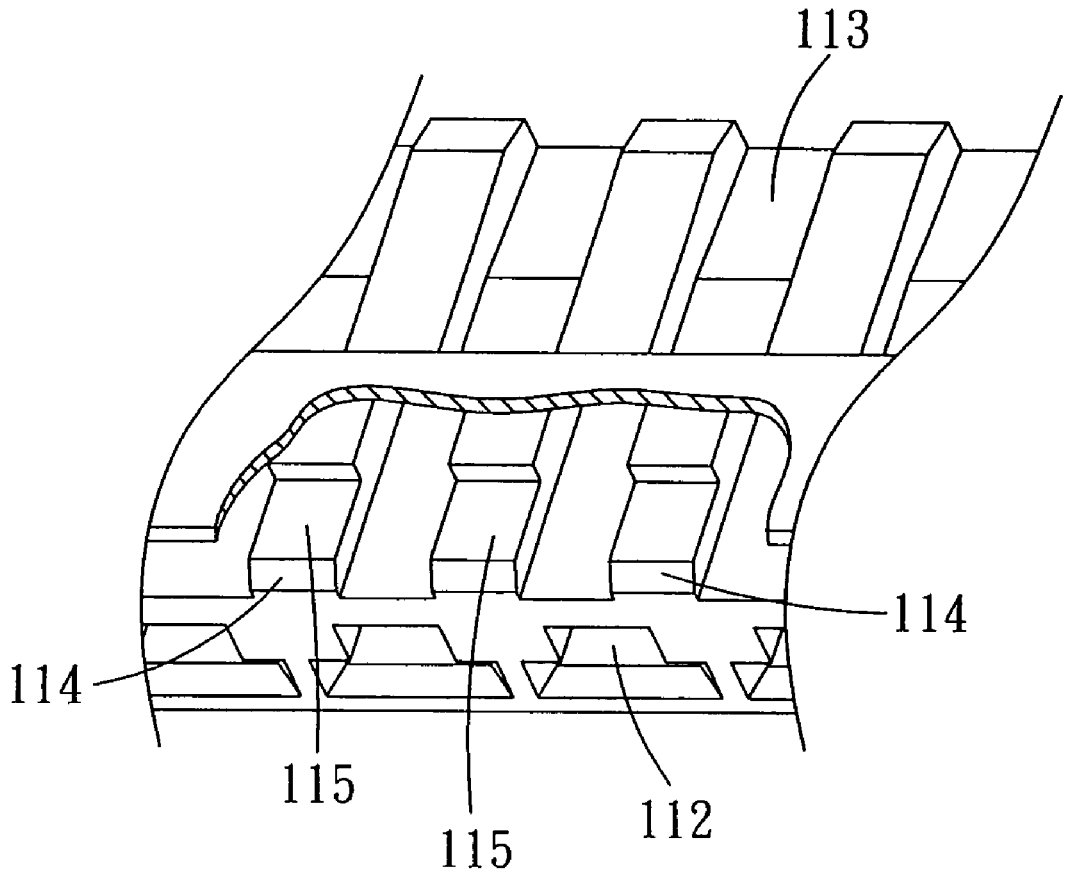
FIG. 4 shows an exploded view of a rear structure of a seat of the present invention.
Figure 5:
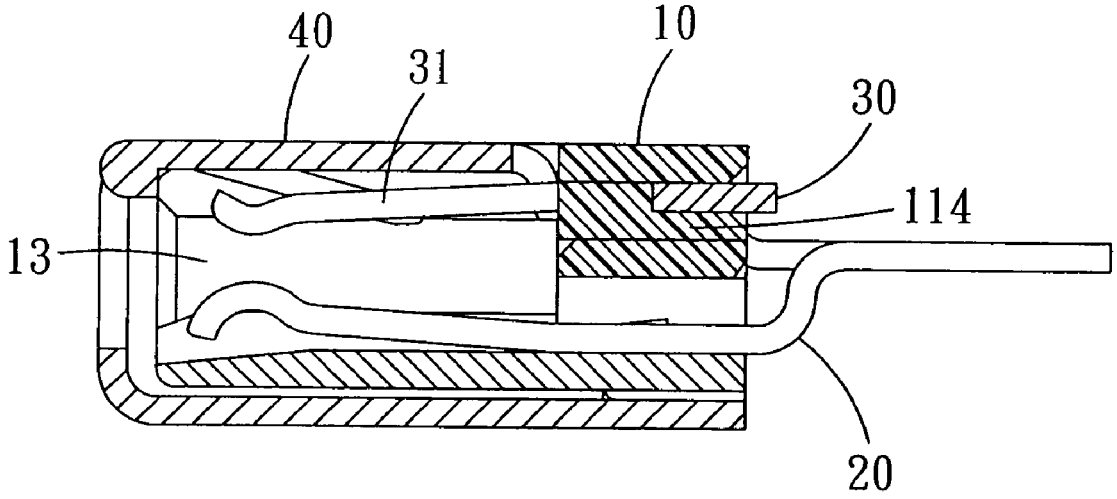
FIG. 5 shows a cross sectional view along a B—B line of FIG. 2.
Figure 6:
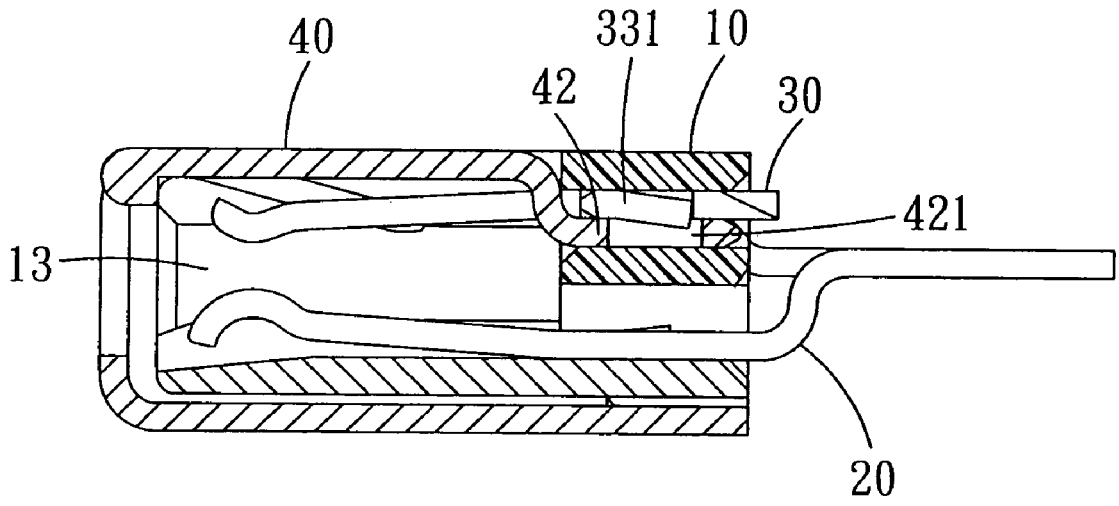
FIG. 6 shows a cross sectional view along an A—A line of FIG. 2.

Referring to FIG. 4, a restriction notch 115 which matches with a thickness of holding element 30 is located above a rear side of each bump 114, such that after the holding element 30 is inserted in the upper slot 111, the inner rims of the first gap 341 and the second gap 342 can be latched in the restriction notch 115, thereby restricting the holding element 30 along an up and down direction (or a third direction A3), and fixing the holding element 30 at an upper half of upper slot 111. Referring to FIG. 5, after the holding element 30 is inserted in the upper slot 111, the holding element 30 will be latched in the restriction notches 115, and the holding terminals 31 will be extended into the holding space 115 and installed in an opposite direction to the conduction terminals 20. Due to the restriction notches 115, the holding element 30 will be fixed at the upper half of upper slot 111; whereas a lower half will form a gap which is partly filled. More particularly, a gap formed below each press piece 33 can just provide for emplacing the spring leaf 42 of casing 40. After the casing 40 and the seat 10 are mutually latched, the latching members 43 at two sides of casing 40 are inserted in the latching holes 122 of seat 10, so as to fix two sides of casing 40. In addition, each spring leaf 42 can be just emplaced in the upper slot 111 at a position corresponding to each press piece 33, such that the spring leaf 42 and the press piece 33 are overlapped in the third direction A3. Referring to FIG. 6, the holding element 30 is located at the upper half of upper slot 111, and the spring leaves 42 of casing 40 are emplaced in the gaps at lower half of upper slot 111 and are overlapped with the press pieces 33. In addition, by a latch mechanism constituted by a fixing hole 421 on the spring leaf 42 and the projection part 331 on the press piece 33, the holding element 30 and the casing 40 are mutually latched and fixed along the first direction A1. Accordingly, the holding element 30 and the casing 40 can be prevented from being separated from a direction of emplacement, and each part can be uniformly fixed along a longitudinal direction, so as to reduce an improper damage such as getting loose or being shifted, and to relatively enhance a holding force to the butted connector.

Figure 7:
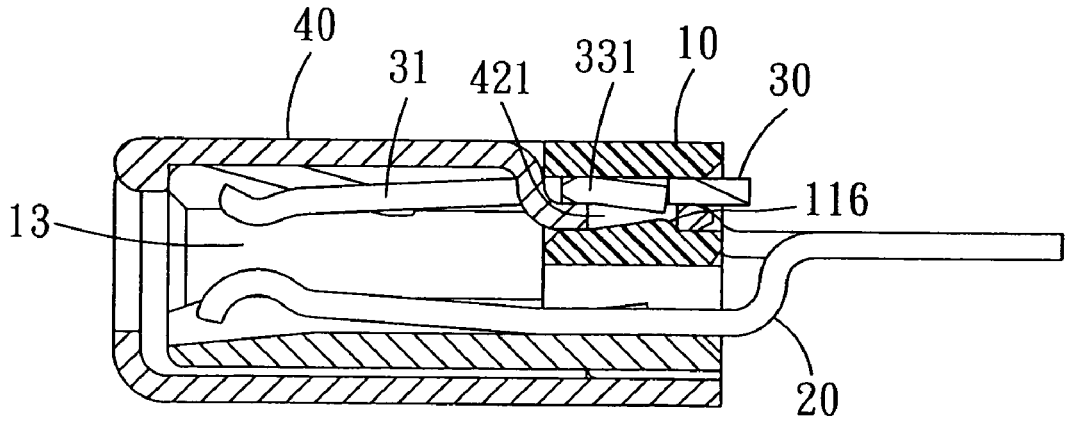
FIG. 7 shows a schematic view of another implementation of the present invention.
Figure 8:
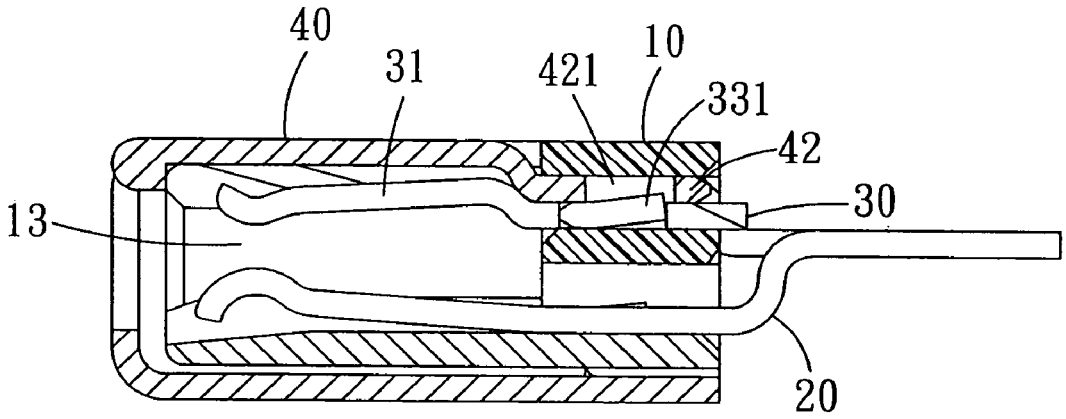
FIG. 8 shows a schematic view of still another implementation of the present invention.

In another implementation, to enhance an immobility among the casing 40, the seat 10, and the holding element 30, a projection point 116 can be added on one side of upper slot 111 of seat 10, at a position corresponding to each fixing hole 421, which will form an interference with the fixing hole 421 to enhance the immobility, as shown in FIG. 7. In addition, the spring leaf 42 of casing 40 can also be inserted in a top of press piece 33, as shown in FIG. 8. As the restriction notch 115 of bump 114 at the upper slot 111 is moved to a lower part at rear side, the holding element 30 will be restricted to the lower half, and the spring leaf 42 of casing 40 will be overlapped at the top of press piece 33 to form a mutual interference, after inserting the holding element 30 in the upper slot 111.

Figure 9:
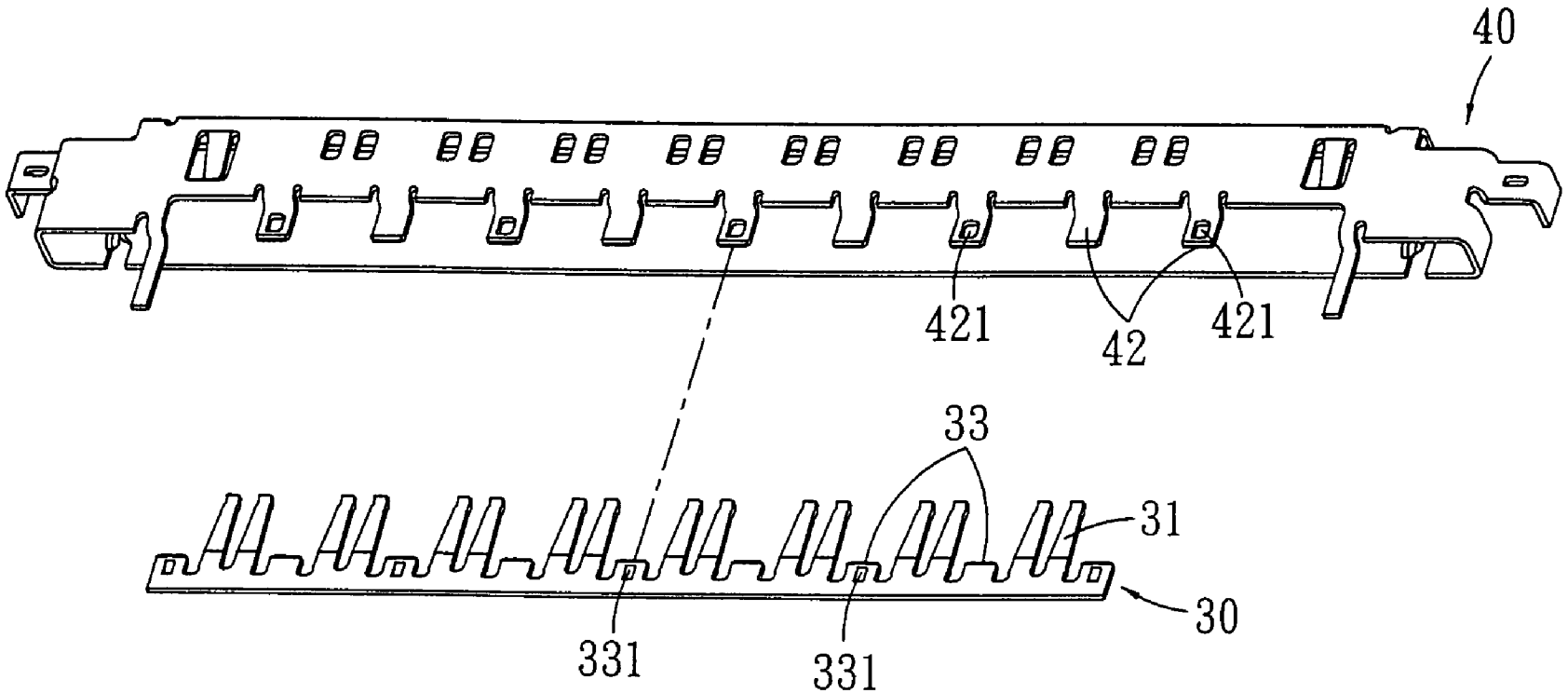
FIG. 9 shows a perspective view of elements of another implementation of the present invention before being assembled.

The quantities of fixing holes 421 of spring leaves 42 and the projection parts 331 of press pieces 33 can be chosen according to a real size and a number of pins of the electronic connector 100, such that they can all be installed or installed alternately, all depending on a requirement of user. For example, as shown in FIG. 9, they are installed alternately. In addition, the alignment method of the holding terminals 31 and press pieces 33 of holding element 30 can be designed as a one by one interval, that is, one holding terminal 31 is next to one press piece 33, instead of one press piece 33 for every two holding terminals 31, depending on a practical requirement of the connector.

The object of installing the holding element 30 in the present invention is to enhance a holding function to the butted connector. As for the grounding connection, the grounding piece 412 installed on the side surface 41 of casing 40 is directly in connection with a grounding part of the butted connector, and is then connected to a grounding circuit of circuit board through the grounding part 44 of casing 40.

Accordingly, the connector of present invention is provided with an extremely good holding function, and can enhance the immobility among all components of connector; therefore, it provides an obvious effect especially for a connector with a thin-type frame.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. An electronic connector with an enhanced holding function comprising a seat which is provided with an upper slot and a plurality of terminal slots; a casing which encloses an outside of seat, constitutes a holding space with the seat, and is provided with a plurality of spring leaves; a plurality of conduction terminals which are inserted in the terminal slots; and a holding element which is extended with a plurality of holding terminals and a plurality of press pieces inserted in the upper slot, and forms an electronic connection with the casing and is interfered with the casing along a first direction, through a mutual contact of the press pieces and the spring leaves, wherein the spring leaf of casing is provided with a fixing hole and the press piece is provided with a projection part, such that an electronic connection is formed between the holding element and casing, by a latch mechanism constituted by the fixing holes and projection parts.

2. An electronic connector with an enhanced holding function comprising a seat which is provided with an upper slot and a plurality of terminal slots; a casing which encloses an outside of seat, constitutes a holding space with the seat, and is provided with a plurality of spring leaves; a plurality of conduction terminals which are inserted in the terminal slots; and a holding element which is extended with a plurality of holding terminals and a plurality of press pieces inserted in the upper slot, and forms an electronic connection with the casing and is interfered with the casing along a first direction, through a mutual contact of the press pieces and the spring leaves, wherein a projection point is located on a side edge of upper slot that is in touch with the spring leaf of casing, and forms an interference with a fixing hole of spring leaf.

3. An electronic connector with an enhanced holding function including a seat which is provided with an upper slot and a plurality of terminal slots; a casing which encloses an outside of seat and constitutes a holding space with the seat; a plurality of conduction terminals which are inserted in the terminal slots; and a holding element which is inserted in the upper slot, and is extended with a plurality of terminal sets and a plurality of press pieces along a same direction wherein the press pieces are alternately installed between terminal sets, wherein the press piece is provided with a projection part.

* * * * *